United States Patent [19]

Hill et al.

[11] Patent Number: 4,488,915

[45] Date of Patent: Dec. 18, 1984

[54] SINGLE-CRYSTAL CASTINGS

[75] Inventors: Anthony D. Hill, Brislington; David A. Ford, Yatton; Michael J. Goulette, Mickleover; Roger P. Arthey, Melbourne, all of England

[73] Assignee: Rolls-Royce Limited, London, England

[21] Appl. No.: 416,008

[22] Filed: Sep. 8, 1982

[30] Foreign Application Priority Data

Sep. 11, 1981 [GB] United Kingdom ..... 8127455

[51] Int. Cl.[3] ..... C22C 19/05

[52] U.S. Cl. ..... 148/404; 148/162; 148/410

[58] Field of Search ..... 420/444, 447, 448, 450, 420/449; 148/3, 162, 404, 410

[56] References Cited

U.S. PATENT DOCUMENTS 2,977,222 3/1961 Bieber ..... 420/449

*Primary Examiner*—R. Dean

*Attorney, Agent, or Firm*—Cushman, Darby & Cushman

[57] ABSTRACT

A relatively low-density Nickel based superalloy particularly suitable for use in the form of a single crystal casting comprised by weight percent:

Chromium: 7–13%
Aluminium: 5–7%
Titanium: 2–5%
Cobalt: 4–16%
Molybdenum and/or Ruthenium: 1–4%
Vanadium: 0–2%
Carbon: 0–0.05%

Balance Nickel plus incidental impurities, the density of the alloy being less than 7.9 kg/dm$^3$.

4 Claims, 4 Drawing Figures

SINGLE-CRYSTAL CASTINGS

This invention relates to an alloy suitable for making single-crystal castings, and to a casting made thereof.

Cast nickel-based alloys and in particular the so-called nickel-based superalloys have been widely used in the past for applications where resistance to high temperatures is required. Such applications are largely found in the hotter parts of gas turbine engines. It has been appreciated in recent years that an improvement in cast objects for operation in these extreme conditions may be made by casting the objects as single crystals rather than in the conventional multi-crystalline form. In general single crystal castings have better high temperature lives and strength than their equi-axed, multi-crystalline counterparts.

However, the nickel based superalloys currently used represent highly developed formulations which have been specifically designed to make the best of the equi-axed, multi-crystalline cast form in which they have been used. When these materials are used in standard form to produce single crystal castings their properties are compromised by the presence and levels of a number of constituents whose major role is to overcome the deficiencies of a multi-crystalline structure.

It is therefore possible to design new alloys which are more accurately tailored to single crystal use. It can also be an advantage for rotating components if the density of the alloy is as low as possible, since the support of such components in a centrifugal field can be a major problem whose magnitude is considerably affected by the density of the alloy involved.

The present invention therefore proposes a range of nickel based superalloys especially tailored for use as a single crystal casting but which also retain the relatively low density of some of the superalloys of the prior art.

According to the present invention an alloy suitable for making single-crystal castings comprises the following constituents by weight percent:

Chromium: 7–13%
Aluminum: 5–7%
Titanium: 2–5%
Cobalt: 4–16%
Molybdenum and/or Ruthenium: 1–4%
Vanadium: 0–2%
Carbon: 0.015–0.05%

Balance Nickel apart from incidental impurities, the density of the alloy being less than 7.9 kg/dm$^3$.

The invention also includes a cast single-crystal object made of an alloy falling within the range set out above.

Examples of alloys in accordance with the invention are set out in the table below as A to G inclusive; alloy H is a commercially available low density nickel-based alloy used for purposes of comparison and not according to the invention.

| | Constituents by weight % | | | | | | | | |
|---|---|---|---|---|---|---|---|---|---|
| Alloy | Cr | Al | Ti | Co | Mo | V | Ru | C | Density kg/dm$^3$ |
| A | 10.0 | 5.5 | 4.0 | 15.0 | 3.0 | 1.0 | — | 0.02 | 7.86 |
| B | 10.0 | 5.5 | 4.0 | 15.0 | 3.5 | — | — | 0.02 | 7.89 |
| C | 11.5 | 5.5 | 4.0 | 15.0 | 3.0 | — | — | 0.02 | 7.86 |
| D | 10.0 | 5.5 | 4.0 | 10.0 | 3.0 | 1.0 | — | 0.02 | 7.86 |
| E | 10.0 | 5.5 | 4.0 | 5.0 | 3.0 | 1.0 | — | 0.02 | 7.86 |
| F | 8.0 | 6.2 | 4.6 | 13.0 | 2.3 | 1.2 | — | 0.02 | 7.73 |
| G | 10.0 | 5.5 | 4.0 | 15.0 | — | 1.0 | 3 | 0.02 | 7.88 |

-continued

| | Constituents by weight % | | | | | | | | |
|---|---|---|---|---|---|---|---|---|---|
| Alloy | Cr | Al | Ti | Co | Mo | V | Ru | C | Density kg/dm$^3$ |
| H | 9.5 | 5.5 | 4.75 | 15.0 | 3.0 | 0.95 | — | 0.18 | 7.9 |

Taking these alloys in turn, Alloy A bears some relation to prior art alloys but in this case the grain boundary strengtheners Zirconium and Boron have been completely omitted as has almost all Carbon. Some Carbon has been retained to assist the refinement of the alloy during preparation, although most of this Carbon will be lost as Carbon Monoxide by reduction of metal oxides and outgassed oxygen during alloy manufacture. To maintain alloy phase stability the content of Titanium is also relatively low at 4%.

Alloy B is as Alloy A but without Vanadium, and to compensate the level of Molybdenum has been increased. It is expected that an improved corrosion resistance will result from the lack of Vanadium.

Alloy C features an increased level of Chromium which should improve the corrosion resistance. To compensate for this and to maximise the oxidation/corrosion resistance, Vanadium has been omitted from the alloy.

Alloys D and E are as Alloy A but with reduced Cobalt levels of 10% and 5% respectively. We have found that the best properties in single crystal alloys are achieved with lower levels of Cobalt than in conventional superalloys, and this reduction in Cobalt helps to reduce the cost of the alloys.

Alloy F is designed to give a high volume fraction of the $\gamma'$ phase. To this end Aluminium, Titanium and Vanadium contents have been increased. To compensate for these increases the proportions of Chromium and Molybdenum have been decreased so as to maintain alloy stability.

Finally Alloy G is similar to Alloy A but here the Molybdenum content is replaced by the atomically similar Ruthenium.

It will be appreciated that these exemplary alloys are illustrative of separate points in the ranges of alloys claimed, which we believe to define a range of alloys having low density and good properties when used in single crystal form.

It will be appreciated that it is usually desirable to heat treat cast superalloy objects to allow them to develop the optimum properties for use. Alloys in accordance with the invention are no exception, and a suitable heat treatment will involve a solution heat treatment step comprising heating to a temperature of above 1250° C. but below the melting point of the alloy for a time of between 1 and 5 hours followed by an ageing step in which the alloy is held at 870° C. for some 16 hours.

In tests of alloys in accordance with the invention, test pieces of alloys A and F from the table above were made up in single-crystal form and various of their properties determined and compared with the commercially available alloy H. The result of these tests are illustrated in the accompanying drawings in which.

It should be noted that alloys A and F were heat treated before testing. Thus a solution heat treatment of 4 hours at 1260° C. was followed by an age of 16 hours at 850° C. In the case of alloy H the results quoted are taken from published information and no further tests were carried out on this material.

Figure 1:
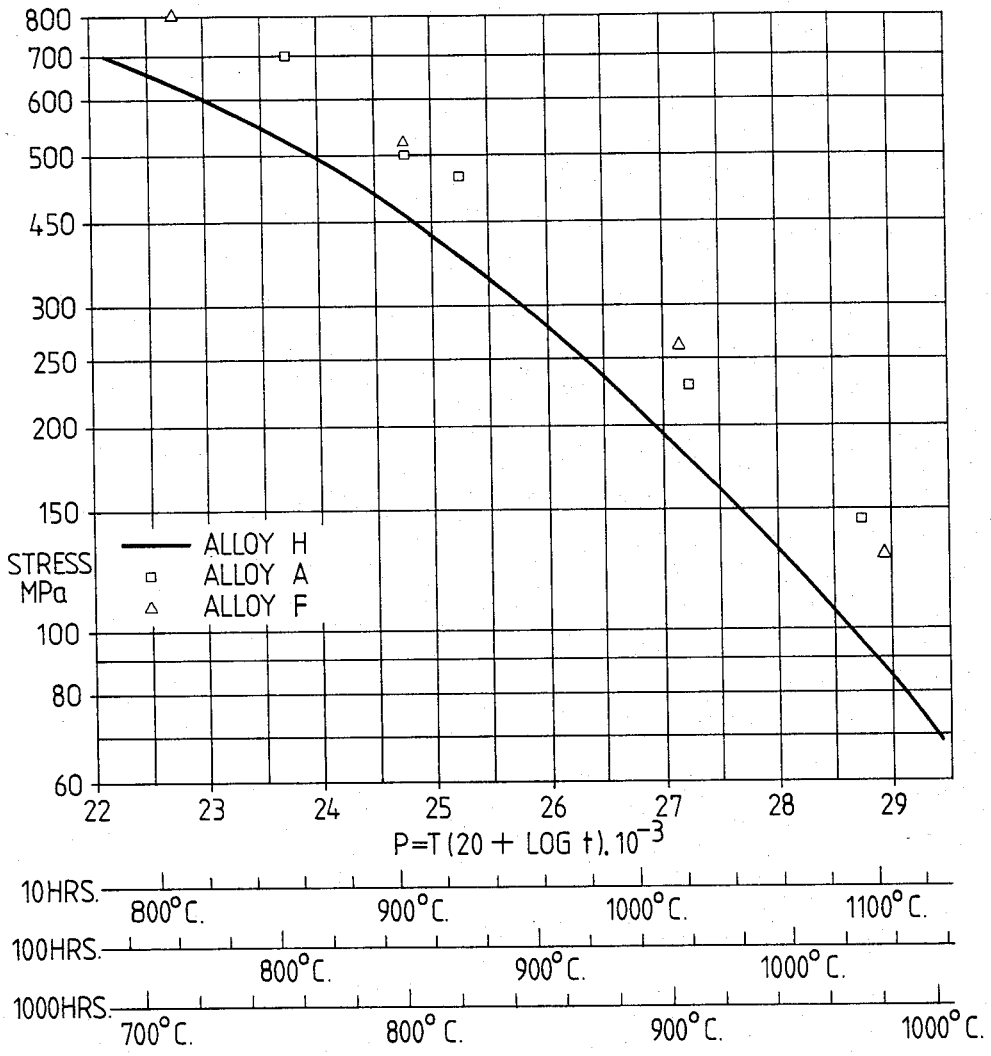
FIG. 1 is a Larsen-Miller plot indicating stress-rupture properties.

Referring first to FIG. 1, this shows a plot know to metallurgists as a Larsen-Miller plot. It shows in graphic form the relationship between stress, on a logarithmic scale, and the Larsen-Miller parameter 'P' which is the product of the temperature of testing 'T' and the sum of the logarithm of the time to failure 't' plus a constant (20 in this case). The parameter is multiplied by a sealing factor ($10^{-3}$ in this case). This plot forms a convenient way of describing the stress rupture properties of the alloys in that the relationship of the three parameters of time to rupture at a given temperature and stress level are illustrated.

In addition to the parameter P, it will be seen that actual values of temperature for given times to rupture are set out as alternative ordinates in FIG. 1. This enables the physical effect of the parameter to be more easily visualised.

To produce the plot of FIG. 1, the published date for alloy H was used to produce the unbroken line while standard stress-rupture tests on the single-crystal specimens of alloys A and F were used to produce the individual results shown as squares for alloy A and triangles for alloy F. It will be seen that the properties of alloys A and F are very close, and that both alloys comfortably exceed the life of alloy H in all the test conditions.

Figure 2:
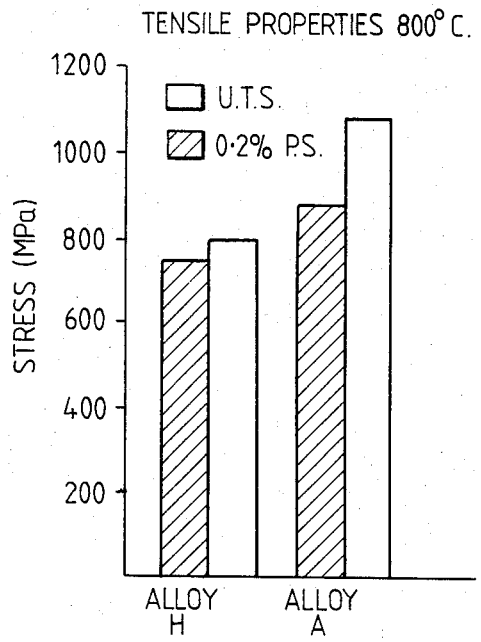
FIG. 2 is a bar-chart illustrating tansile properties.

The bar-chart of FIG. 2 shows the ultimate tensile strengths and 0.2% proof strength of alloys A and H; once again the results for alloy A were produced by standard tests on single crystal test pieces while those for alloy H are published results. Again it will be seen that alloy A is significantly better than alloy H.

Figure 3:
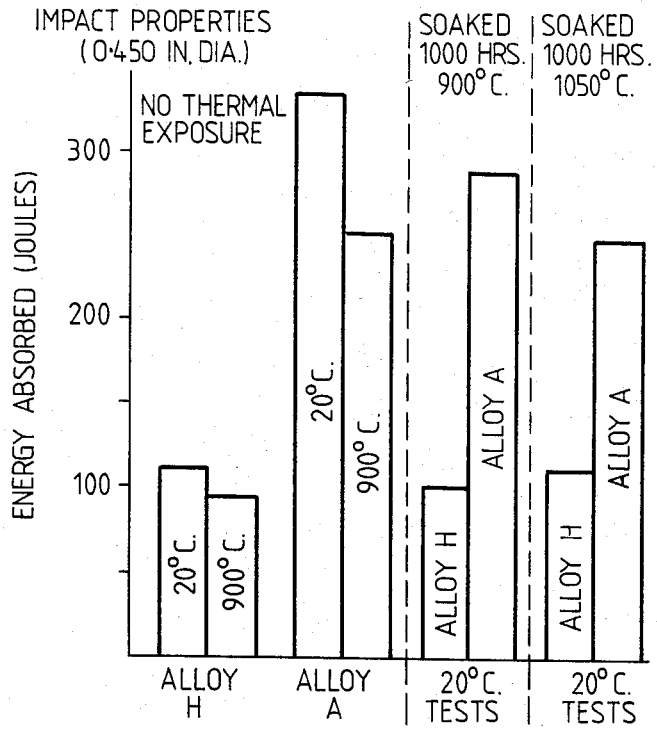
FIG. 3 is a bar chart illustrating impact properties after various pre-treatments.
Figure 4:
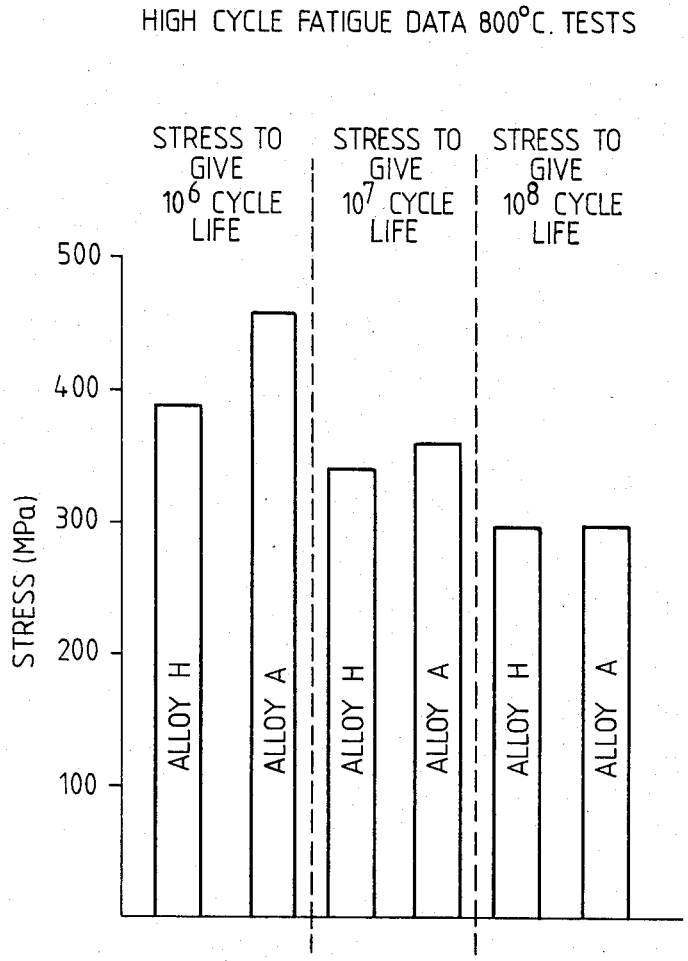
FIG. 4 is a bar chart illustrating high cycle fatigue properties.

In a similar fashion FIG. 3 shows the respective impact properties of alloys A and H, determined in a standard test which measures the energy absorbed in fracturing standard test-piece. These tests were carried out at room temperature and at high temperature, and the room temperature tests included test pieces previously soaked at high temperature for specified periods. There is a clear advantage to alloy A in that the energy absorbed is over twice that for alloy H in all the tests.

Finally, alloy A was tested to determine its high cycle fatigue properties. This involved repeatedly cycling the stress on a test piece between a maximum and minimum stress level while the test piece was held at high temperature (800° C.). From these results the stress levels which give lives of $10^6$ $10^7$ and $10^8$ angles were determined.

In this case, the results determined for alloy A, although slightly better than the published data for alloy H, are not as markedly different as in the previous cases. However, the properties of alloy A in this respect at least match up to those of the presently used alloy. It will be seen that these test results clearly indicate the superiority of the single-crystal alloy A over the prior art standard low-density alloy H, and that the test of FIG. 1 show that alloy F is also superior to H in one important aspect.

It will be noted that the alloys of the invention are of low density, and this makes them especially suitable for rotating parts such as blades. Using the alloys of the invention, single crystal materials can directly replace the current low-density superalloys with benefits in life and/or higher temperature capability. Again, for advanced designs of engines where the speeds and hence centrifugal loads are high, it is advantageous to use a low-density material such as those of the present invention.

We claim:

1. A single crystal casting made of a nickel-based alloy which has been heat treated at between about 1,250° C. and the melting point of the alloy for between about 1 and 5 hours and subsequent aging for at least 16 hours at a temperature of about 870° C., said single crystal casting consisting essentially of, by weight percent, chromium: 7–13%
aluminium: 5–7%
titanium: 2–5%
cobalt: 4–16%
molybdenum and/or ruthenium: 1–4%
vanadium: 0–2%
carbon: 0–0.05% balance nickel plus incidental impurities, the density of the alloy being less than 7.9 kg/dm$^3$.

2. An alloy as claimed in claim 1 consisting essentially of, by weight percent,

Chromium: 7–11%
Aluminium: 5–6.5%
Titanium: 3–5%
Cobalt: 12–16%
Molybdenum: 2–3.5%
Vanadium: 0.5–1.5%
Carbon: 0–0.05%

Balance Nickel plus incidental impurities.

3. An alloy as claimed in claim 2 and consisting essentially of, by weight percent, Chromium: 10.0%
Aluminium: 5.5%
Titanium: 4.0%
Cobalt: 15.0%
Molybdenum: 3.0%
Vanadium: 1.0%
Carbon: 0.02%

Balance Nickel plus incidental impurities.

4. An alloy as claimed in claim 2 and consisting essentially of, by weight percent, Chromium: 8.0%
Aluminium: 6.2%
Titanium: 4.6%
Cobalt: 13.0%
Molybdenum: 2.3%
Vanadium: 1.2%
Carbon: 0.02%

Balance Nickel plus incidental impurities.

* * * * *